United States Patent [19]

Pels

[11] Patent Number: 4,466,733

[45] Date of Patent: Aug. 21, 1984

[54] HIGHER PRODUCTIVITY RECIRCULATIVE DOCUMENT COPYING

[75] Inventor: Susan J. Pels, Rochester, N.Y.

[73] Assignee: Xerox Corporation, Stamford, Conn.

[21] Appl. No.: 448,654

[22] Filed: Dec. 10, 1982

[30] Foreign Application Priority Data

Sep. 21, 1982 [EP] European Pat. Off. ..... 82304965.5
Sep. 21, 1982 [EP] European Pat. Off. ..... 82304964.8

[51] Int. Cl.[3] ..... G03G 15/00

[52] U.S. Cl. ..... 355/14 R; 355/24; 355/26; 355/77; 355/14 CU

[58] Field of Search ..... 355/14 CU, 14 SH, 14 R, 355/23, 24, 26, 50, 3 SH, 77; 271/3.1

[56] References Cited

U.S. PATENT DOCUMENTS

| | | | |
|---|---|---|---|
| 3,615,129 | 10/1971 | Drawe et al. | 355/3 |
| 3,645,615 | 2/1972 | Spear, Jr. | 355/3 |
| 4,076,408 | 2/1978 | Reid et al. | 355/14 |
| 4,078,787 | 3/1978 | Burlew et al. | 271/3.1 |
| 4,093,372 | 6/1978 | Guenther | 355/50 |
| 4,099,150 | 7/1978 | Connin | 355/26 |
| 4,116,558 | 9/1978 | Adamek et al. | 355/24 |
| 4,172,655 | 10/1979 | Wood | 355/26 |
| 4,179,215 | 12/1979 | Hage | 355/50 |
| 4,210,319 | 7/1980 | Hynes | 271/3.1 |
| 4,278,344 | 7/1981 | Sahay | 355/14 SH |
| 4,330,197 | 5/1982 | Smith et al. | 355/23 X |
| 4,355,880 | 10/1982 | Stemmle | 355/3 SH |

OTHER PUBLICATIONS

Rood, A. J. et al., "Dual Duplex Trays in an Electrophotographic Copier", IBM Technical Disclosure Bulletin, vol. 22, No. 7, Dec. 1979, pp. 2657–2659.

Anonymous disclosure, "Duplex copying system", Research Disclosure, Feb. 1980, No. 19015, p. 61.

Dunleavy, Jr., James E., "Collating document feeder and reproduction apparatus having copy duplexing capabilities", Research Disclosure, Nov. 1977, No. 16332, pp. 49–52.

*Primary Examiner*—R. L. Moses

[57] ABSTRACT

In recirculatively precollatively copying a set of plural simplex original documents onto both sides of copy sheets to produce a desired plural number precollated duplex copy sheet sets, by normally copying the documents only once in each copying circulation of the document set, and by forming a buffer set of copies of alternate document pages being duplexed which buffer set copies are printed on only one side, and temporarily stored in a duplex store and by copying alternate documents onto the opposite sides of the buffer set copies in proper sequence to form collated duplex copy sets, and wherein said documents are all copied unidirectionally in reverse (N to 1) page order, the improvement comprising: counting the number of documents in the document set and determining that the number of documents is more than three but less than approximately ten, and in response to that determination, automatically switching the mode of copying the document sheets to a higher productivity small document set mode including the steps of initially building two complete and identical buffer sets of alternate page documents on two initial copying circulations of the document set and placing both identical buffer sets in the same duplex store and then skipping the copying of the alternate document pages in the two buffer sets in the final two copying circulations of the document set to deplete the two buffer sets. If the number of copy sets made is greater than two, all of the documents are copied in all intermediate document copying circulations (other than said first two and said last two copying circulations) to maintain the two buffer sets during these intermediate circulations by simultaneously rebuilding and depleting the two buffer sets.

2 Claims, 2 Drawing Figures

HIGHER PRODUCTIVITY RECIRCULATIVE DOCUMENT COPYING

Figure 1:
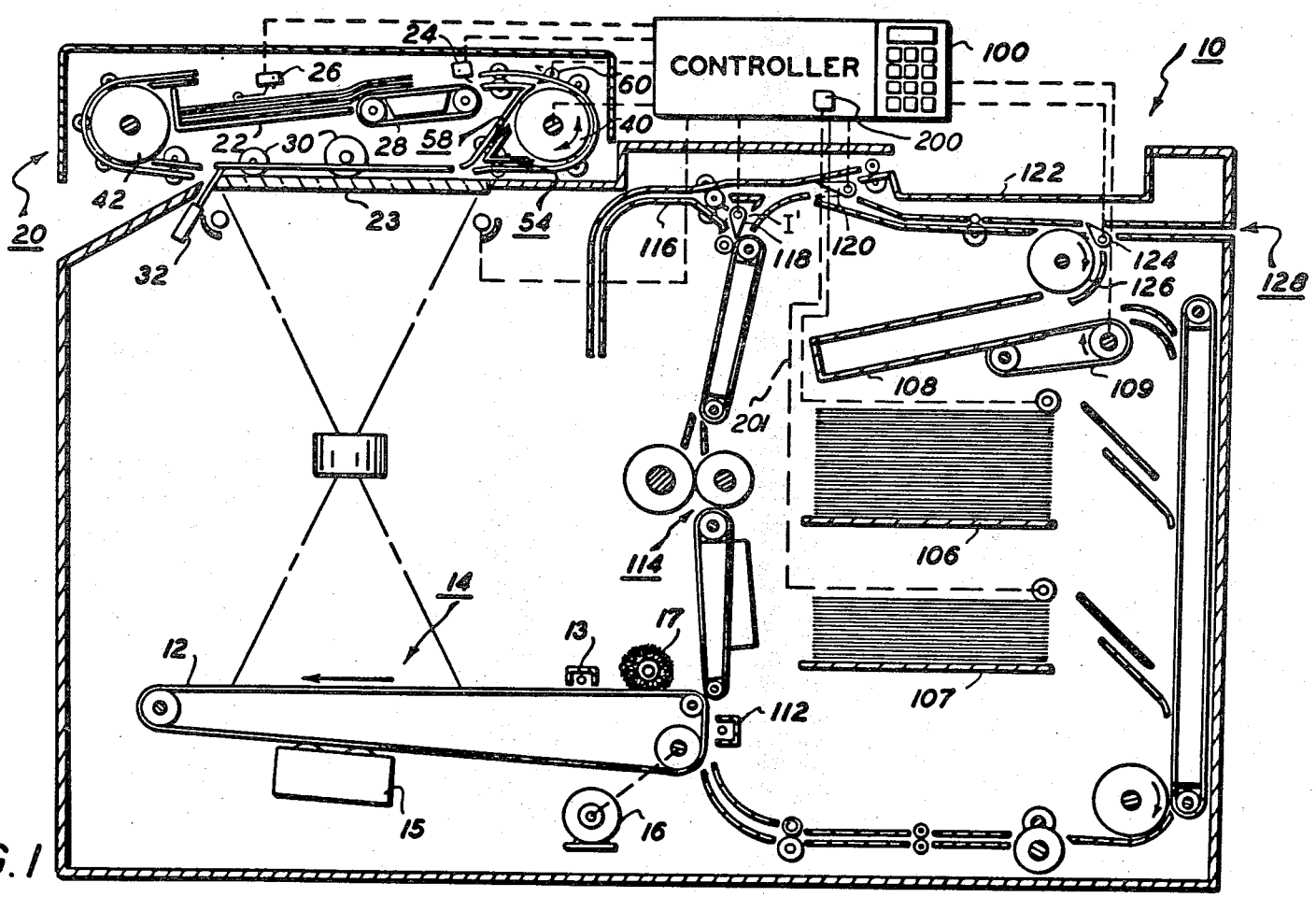

The present invention relates to an improved system for providing more efficient recirculatory precollation copying of sets of original document sheets for special conditions of small document sets.

The exemplary copier and document recirculating and inverting apparatus disclosed herein is also disclosed in U.S. Pat. No. 4,278,344 issured July 14, 1981 to Ravi B. Sahay, and in U.S. Pat. No. 4,355,880 issured Oct. 26, 1982 to Denis J. Stemmle, both with this same assignee. An advantage of the present system is that it may be used with that disclosed apparatus without substantial modification. However, the present system is not limited to that apparatus or application and is usable with various other recirculative document handlers and copiers.

As xerographic and other copiers increase in speed, and become more automatic, it is increasingly important to provide higher speed yet more reliable and more automatic handling of both the copy sheets and the original documents being copied, i.e. both the output and input of the copier. However, the providing of recirculative document copying for precollation copying, especially for duplex (two-sided) copies, greatly complicates and increases the document sheet and copy sheet handling complexities.

The following terminology is generally used in the description herein: The term "sheet" generally refers to conventional sized flimsy sheets of paper, plastic, or other conventional or typical individual image substrates (original or copy), and not to microfilm or electronic images which are generally much easier to manipulate. However, the terms "document" or "document paper" in the claims here, unless otherwise specified, may also be read on encompassing laser printed or otherwise electrically generated, stored or rearranged images. The term "page" here generally refers to one side or "face" of a sheet or the image thereof. A "simplex" document or copy sheet is one having its page and image on only one side or face of the sheet, whereas a "duplex" document or copy sheet has pages on both sides. The term "duplex copying" may be more specifically defined into several different known copying modes. In "duplex/duplex" copying, both sides (both pages) of a duplex document sheet are copied onto both sides of a copy sheet. In "duplex/simplex" copying, both sides of a duplex document are copied onto one side of two successive copy sheets. In "simplex/duplex" copying, the two page images of two successive simplex document sheets are copied onto the opposite sides of a single copy sheet. In non-duplex copying, i.e. "simplex/simplex" copying, one side of each simplex document is copied onto one side of each copy sheet. In the printing industry, as opposed to the copier industry, two-sided copying may be referred to as 37 backing-up" rather than duplex copying. A commercially desirable precollation document handling system should compatibly provide all of these copying modes, although "duplex/simplex" need not be provided.

The present system particularly relates to a "simplex/duplex" precollation copying system which is fully compatible, with the same apparatus, with all of the other said copying systems.

"RDH" is an abbreviation for an automatic recirculating document handler, in which document sheets are automatically fed from a stack, copied and returned thereto, normally for a precollation copying system. The present system is particularly suited for a precollation (multiply recirculated) document copying system, but is also compatible with non-precollation copying with the same apparatus.

Precollation, or collation copying, as it is variably called, is a known desirable feature for a copier, which provides a number of important advantages. In precollation copying any desired number of precollated copy sets may be made by making a corresponding number of recirculations of the original document set in collated order past the copier imaging station and copying each document page only once each time it circulates past the imaging station. The copies automatically exit the copier in precollated sets, and thus do not require subsequent sorting in a sorter or collator. On-line finishing and/or removal of completed copy sets may thus be provided while further copy sets are being made from the subsequent circulations of the same document set.

However, a disadvantage of precollation copying systems is that the documents must all be repeatedly circulated, and copied in a predetermined order, by a number of circulations equivalent to the desired number of copy sets. Thus, increased document handling is necessitated for a precollation copying system, as compared to a post-collation copying system. Also, for duplex copying the copy sheets must normally also be, recirculated once in the copying path in coordination with the document set recirculation in order to print images on both sides thereof. Therefore, maximizing document handling automation and copying cycle efficiency is particularly important in precollation copying. If the document handler cannot efficiently and rapidly circulate and copy documents in coordination with copy sheets in the correct order, or must excessively skip documents or copying cycles, the total copying time for completing all of the copy sets will be increased. Also, minimizng the time delay from the initiation of copying until the first copy set is completed is another important factor. This is known as "first copy out time".

In contrast, in a post-collation copying system, plural copies are made at one time from each document page and collated by being placed in separate sorter bins. The document set need only normally be circulated or manually or semi-automatically fed to the imaging station once and multiply copied to fill the bins of the copy sheet sorter or collator with the corresponding number of copy sets. However, the number of copy sets which can be made in one document circulation is limited by the number of available bins. Also, a sorter adds space and complexity and is not well suited for online finishing. However, post-collation copying and manual document placement are desirable in certain copying situations to minimize document handling. Thus, it is desirable that a precollation copying system be compatible with, and alternatively usable for, post-collation copying as well.

Both forward serial order (1 to N) and reverse order (N to 1) precollation copying of original documents is known for both simplex (onesided) and duplex (two-sided) original documents and copies, as shown in the cited art. A recent 1 to N or normal forward serial order, and face-down stacking, document recirculation systems for precollation simplex or duplex copying systems is disclosed in allowed U.S. Pat. No. 4,229,101 by T. J. Hamlin et al.. Another example thereof is disclosed in U.S. Pat. No. 4,234,180 by J. H. Looney. However, in current products and said art, N to 1 (reverse order) document set circulation is conventional for systems feeding from a stack of documents positioned (loaded) over a platen of a copier. In such conventional systems the documents are loaded face-up and fed out from the bottom of the stack and restacked on the top of the stack. The simplex documents are circulated by being turned over, copied, turned over again, and returned back to the top of the stack over the platen.

A major disadvantage of such N to 1 or backwards document feeding and copying order is that the copier controller does not know what document is being fed on the first circulation, since the last page is fed first. Not knowing whether the documents being fed are odd or even, and duplexing accordingly, has distinct disadvantages for making duplex (two sided) copies. If the number of original document pages is odd, the last duplex copy sheet will be blank on one side. This problem has lead to simplex/duplex copying with either precounting of the entire document set before copying in a noncopying circulation and/or selective use of a copy sheet inverter in the copy sheet path and other disadvantages, as explained more fully in U.S. Pat. Nos. 4,330,197 and 4,278,344, and in U.S. Pat. No. 4,166,614 at Col. 18. That is, commercial RDH copying systems generally feed documents in backwards or reverse page order, i.e. from the last or Nth page to the first page, as further described hereinbelow. Thus for simplex/duplex copying a non-copying initial counting circulation of simplex documents has been considered essential for such N to 1 (reverse page order) RDH systems. This is disclosed in said U.S. Pat. No. 4,330,197 by R. E. Smith and J. R. Yonovich and the same assignee. This automatically determines whether the Nth (first copied) document is odd or even, but reduces first-copy-out-time.

Such precount cycles and/or selective use of a copy sheet inverter adversely affect the system reliability by requiring extra handling of the document set and running the copy sheets past additional deflector fingers and in and out of an inverter, with extra or different handling and timing. In addition, for a large document set the precount cycle may decrease the perceived productivity of the system by cycling the document handler without imaging the originals at the beginning of copying when it is most noticeable and when there is no copy sheet output finishing or handling to occupy the operator's time. For a larger document set there is a corresponding increase in first copy out time for simplex/duplex copying using a pre-count circulation.

Not knowing whether a document being fed is an odd or even page number on the first circulation particularly complicates the simplex/ duplex operation of a copier when it is desired to use letterhead, binder edged, prepunched, marginal, or other special copy sheets which require a particular face or orientation of the copy sheet to be printed or bound. For example, with letterhead paper, for duplex copying page 1 must be printed on the letterhead side, not the obverse side. Using paper with ring or spiral binder holes, the odd document pages should be copied so that the holes are on the left hand side of the page and the even document pages should be copied so that the holes are on their right. If the copier finisher has a stapler positioned for one corner, the copy sheets should be placed in the finisher automatically in the correct orientation for stapling in the correct corners However, N to 1 document recirculation has been commercially utilized in spite of these disadvantages because it is suitable and conventional for a "racetrack" or over-platen loop circulation path, in which the documents are recirculated to and from a document stack located over the copier platen, as shown in the cited references. Simplex documents are fed from one edge of the stack to the same side or edge of the platen underneath the stack and back from the opposite edge of the platen to the opposite edge of the stack, and therefore may be stream fed unidirectionally over the platen, feeding one document on while the prior one is feeding off. The document path has a 180° loop turn at each side of the platen which is generally a short path. With such a shorter and unidirectional "racetrack" loop path length, document transport speeds can be lower and two or three sheet document set handling with less skipped copy cycles can be achieved more easily than with most non-racetrack systems.

By way of further background as to known difficulties in integrating precollation document recirculation with duplex copying, in a properly collated set of duplex copy sheets the odd pages 1, 3, 5, etc., should normally appear on the first or front faces or sides, and only the next higher page number even pages 2, 4, 6, etc., should normally be on the respective second or back sides. The order of copying the document pages and the order of presenting the copy sheets to the images thereof must be coordinated to maintain proper page order for collation. Also, the number of duplex sheets will always be less than the number of pages on those duplex sheets. In contrast, in a set of simplex document or copy sheets, the number of the sheet will typically also correspond to the page number. Thus, an odd number of simplex sheets will normally also have a corresponding odd number of page images. However, a set of duplex sheets, regardless of the sheet count, may have an odd or even number of pages. If there are an odd number of pages in the set of duplex sheets the back side of the last sheet will normally be blank (empty). Other difficulties involved in efficient duplexing systems and sequences, which are compatible with both simplex and duplex systems, are discused in the art cited herein and other duplexing art.

Of interest as relating to improved simplex/duplex precollation system efficiency is U.S. Pat. No. 4,116,558, issued Sept. 26, 1978, to J. A. Adamek et al.. That system is also described in other above-cited patents. This Adamek patent teaches a more efficient RDH system for making duplex precollated copy sets compatible with simplex copying and usable with the present invention, in which all of the simplex documents may be recirculatively copied on all but the first and last copying circulations, and in which alternate simplex documents are copied on the first and last circulation (by circulating all documents but not exposing alternate ones) to form and remove a duplex copy buffer set, but with copying of all simplex documents on all other circulations (with alternate feeding of clean or buffer set copy sheets to the photoreceptor for imaging alternate pages on opposite sides thereof and to maintain a buffer set until the last coping circulation).

Some examples of fuller details of preferable recirculating document handlers are disclosed in U.S. Pat. Nos. 4,335,954 issuing June 22, 1982 to Russell L. Phelps; 4,270,746 issued June 2, 1981 to T. J. Hamlin and 4,076,408 issued Feb. 28, 1978 to M. G. Reid, et al.. U.S. Pat. No. 4,078,787 issued March 14, 1978 to L. E. Burlew et al. is noted as to copying a single simplex document in an RDH without any circulation (since single page copy sets cannot, of course, be collated). Also of interest is U.S. Pat. No. 4,093,372 issued June 6, 1978 to Joachim Guenther, teaching an RDH copying system which switches from a precollation to a post-collation mode of copying automatically in response to operator selection of a preset (larger) number of desired copy sets.

By way of further background, another recent example of a duplex or simplex document recirculation precollation copying system is disclosed in Disclosure Number 16332, pp. 49–52, of the November 1977 issue of "Research Disclosure", published by Industrial Opportunities, Ltd., Homewell, Havant, Hampshire, U.K. and its equivalent disclosure in U.K. Application No. 2,000,749A published January 17, 1979.

The anonymous Disclosure Number 19015 published February 1980 in said "Research Disclosure" is of interest as merely suggesting that when duplex original documents are being copied onto duplex copy sheets in a ("immediate duplex") system where the duplex documents must be immediately inverted each time for copying opposite sides in immediate sequence, that the consequent copying speed loss can be compensated for to some extent by making two consecutive copies of the same original each time. However it requires 2 copy receiver trays.

Further by way of background, it is known that non-precollation duplex copying (for either duplex/duplex or simplex/duplex copying) may be done by first making in the copier processor a "buffer set" comprising a plurality of simplexed copy sheets (printed only on their first sides). The buffer set sheets are temporarily stored, preferably in a duplex buffer tray, and then fed back through the same copying processor for a second pass printing of the proper opposite page on their opposite sides. Such systems may be referred to as sequential or dual pass duplexing systems, and are used, for example, in the "Xerox" "4000" (without an RDH) and in the "9400" Xerox Corporation copiers. Examples of such systems for handling the copy sheets being duplexed are shown in U.S. Pat. Nos. 3,615,129, issued Oct. 26, 1971 to W. A. Drawe, et al. and 3,645,615, issued Feb. 29, 1972, to M. R. Spear, Jr.. In such non-precollation duplexing system all the sheets in the buffer set are normally identical copies of the same, single, document page.

In contrast, for precollation duplex copying the buffer set copies are not identical. Each buffer set has one copy of each different document page, and thus their order and orientation must be maintained and coordinated with the document pages to be printed on their opposite sides. As noted in the above-cited U.S. Pat. No. 4,278,344 to Sahay at Col. 2 lines 6–16 the references cited there teach that two buffer sets may be provided in the special situation of bidirectional copying where copies are made in two different orders (1-N then N-1) in a special document feeder and copier. These cited references are U.S. Pat. Nos. 4,116,558 (cited above) (Col. 6, top) and 4,172,655, Col. 4, lines 37–39 and 64-end. Also noted in that regard is commonly assigned U.S. Pat. No. 4,210,319, especially Col. 3, lines 46–58. These are different (different order) buffer sets, as are those in IBM Technical Disclosure Bulletin Vol. 22, No. 7, pp. 2657–2659, Dec. 1979.

Examples of various other patents teaching conventional document handlers and also control system therefor, including document path switches and counters, are U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344 and 4,284,270. Conventional simple software instructions in a copier's conventional microprocessor logic circuitry and software of document handler and copier control functions and logic, as taught by the above and other patents and various commercial copiers, are well known and preferred. However, it will be appreciated that the document handling functions and controls described herein may be alternatively conventionally incorporated into a copier utilizing any other suitable or known simple software or hard wired logic system, switch controllers, etc.. Such software for functions described herein may vary depending on the particular microprocessor or microcomputer system utilized, of course, but will be already available to or readily programmable by those skilled in the art without experimentation from the descriptions provided herein.

The control of all of the exemplary sheet handling systems disclosed herein may be accomplished by conventionally activating them by signals from the controller in response to simple programmed commands and switch inputs from the copier console selected by the operator, such as selecting the number of copies, selecting simplex or duplex copying, selecting whether the documents are simplex or duplex, etc.. These signals may conventionally actuate conventional electrical solenoid or cam controlled sheet deflector fingers and drive motors or their clutches in the selected steps or sequences as programmed. Conventional sheet path sensors or switches and bail bars, connected to the controller, may be utilized for counting and keeping track of the positions of documents and copy sheets, as is well known in the art, and taught in the above and other patents and products. Known precollation copying systems utilize such conventional microprocessor control circuitry and connecting switches for counting the number of document sheets as they are recirculated, counting the number of completed document set circulations, and thereby controlling the operation of the document and copy sheet feeders and inverts, etc..

All references cited herein, and their references, are incorporated by reference herein for appropriate teachings of additional or alternative details, features, and/or technical background.

The present invention desirably overcomes or reduces various of the above-discussed problems.

A general disclosed feature herein is to specially control the sequence of document and copy sheet feeding and copying so as to provide more efficient, more rapid, precollation copying with a recirculating document handling system of smaller document sets, more specifically, document sets with less than approximately 9 sheets.

A further general disclosed feature is to change the mode of precollation copying for small copy sets depending on and controlled by the number of pages for increasing copying efficiency.

A preferred specific feature disclosed herein is to provide a method of recirculatively precollatively copying a set of plural simplex original documents onto both sides of copy sheets to produce a desired plural number precollated duplex copy sheet sets, by normally copying the documents only once in each copying circulation of the document set, and by forming a buffer set of copies of alternate document pages being duplexed which buffer set copies are printed on only one side, and temporarily stored in a duplex store and by copying alternate documents onto the opposite sides of the buffer set copies in proper sequence to form collated duplex copy sets, and wherein said documents are all copied unidirectionally in reverse (N to 1) page order, the improvement comprising: counting the number of documents in the document set and determining that said number of documents is more than three but less than approximately six; in response to said determination, automatically switching the mode of copying said document sheets to a higher productivity small document set mode comprising the steps of initially building two complete and identical said buffer sets of alternate page documents on two initial copying circulations of said document set and placing both said identical buffer sets in the same duplex store and then skipping the copying of said alternate document pages in said two buffer sets in the final two copying circulations of said document set to deplete said two buffer sets.

Further features which may be provided by the method and apparatus disclosed herein, individually or in combinations, include those wherein if the number of copy sets made is greater than two, all of the documents are copied in all intermediate document copying circulations (other than said first two and said last two copying circulations) to maintain said two buffer sets during said intermediate circulations by simultaneously rebuilding and depleting the two buffer sets.

Figure 2:
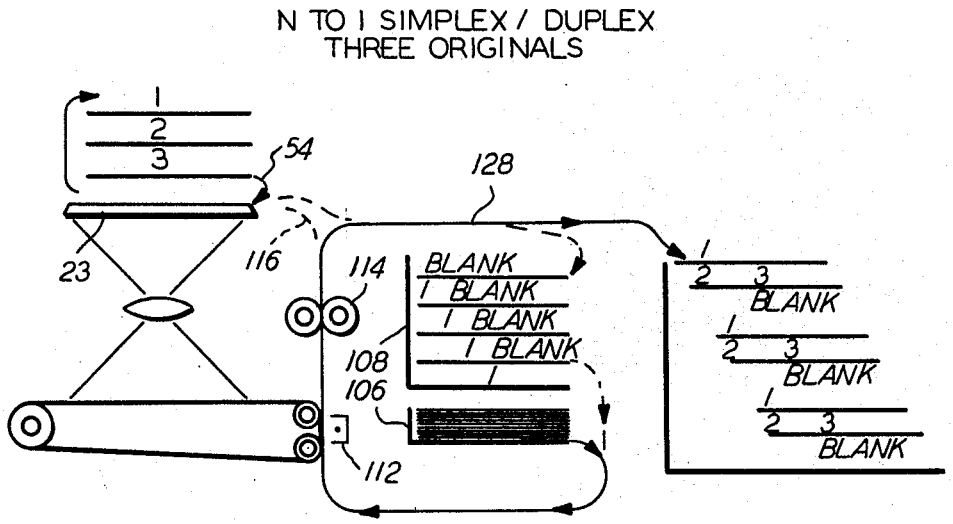

FIG. 1 is a schematic side view of an exemplary copier and an exemplary recirculating document handler therefor with which the present invention may be practiced; and FIG. 2 shows schematic document and copy sheet paths for exemplary efficient N to 1 order simplex/duplex copying on the apparatus of FIG. 1 for precollation copying for a 3-page (3-sheet) simplex document set.

Referring first to the exemplary xerographic copier 10 shown particularly in FIG. 1 and its exemplary automatic document feeding unit 20, it will be appreciated that various other alternative recirculating document feeding units and copiers may be utilized with the present invention, including various ones disclosed in the above-cited references.

In the exemplary N to 1 order recirculating document handler (RDH) 20 disclosed here, individual original document sheets are sequentially fed from a stack of document sheets placed by the operator face-up in normal forward collated order in the document stacking and holding tray 22, i.e. with page 1 on the top of the stack. Document sheets are fed from the bottom of the stack seriatim to the imaging station 23, which is the conventional copying platen of the copier 10, to be conventionally imaged onto a photoreceptor 12 for the production of copies in a generally conventional xerographic manner. The documents are stacked initially, and also restacked automatically during each circulation, in the tray 22 over the platen 23. The document handler 20 has conventional switches or other sensors such as 24 for sensing and counting the individual documents fed from the tray 22, i.e. counting the number of document sheets circulated. A conventional resettable bail or finger drops to indicate through its associated set-counter switch or sensor 26 the completion of each circulation of the complete document set, by sensing that all the documents have been fed out from under it, and then is automatically reset on the top of the stack before the next circulation. The document feeder 20 is adapted to serially sequentially feed the documents, which may be various conventional sizes and weights of sheets of paper or plastic containing information indicia to be copied on one or both sides, e.g. printed or typed letters, drawings, prints, photographs, etc.. A bottom feeder 28 feeds the bottom-most document sheet, on demand by the controller, from the stack through one of two selected feed paths described below to a platen transport 30 which moves the document into a registration position, against a registration gate 32, over the copier platen 23, where the side of the document facing the platen 23 is copied.

In this document feeder 20 each document is selectably inverted or not inverted as it is fed from the tray 22 to the imaging station 23 through one of two paths selectable by the controller. Thus, this is accomplished here before the document is copied. The two paths here are provided by a selectably reversable sheet drive roller (inverting roller) 40 and a selectable position gate or deflector 60 in the document path. Each document sheet is fed initially from tray 22 around the outside of the roller 40. If the document path is continued around roller 40, it is fed invertedly through a first (simplex document) path 54 onto the platen 23.

The decision gate 60 in the document path here is adjacent the entrance to roller 40 and comprises pivotable, normally raised, deflector fingers which may be lowered after the trail edge of the document has passed this gate. (Switch 24 or another switch can sense the trail edge and start a count of sufficient time for it to pass). Subsequent actuation of the gate 60, together with coordinated reversal of the roller 40, causes the further recirculatory movement of the document to reverse and pass through a second and different transport path 58 to the platen for copying. In the art this is called an "inverter" even though the document is not inverted at this point, as described below. The second transport path 58 provides no sheet inversion between the stack and the platen, whereas the first transport path 54 inverts the document sheet (once) between the stack and the platen. The path 58 provides for duplex document inversion, for copying both sides of the duplex document set as described in detail in the cited U.S. Pat. No. 4,278,344 patent.

In the inverter operation for path 58, the reversal of the roller 40 causes the documents to only go partially around the roller 40 and then be reversed in direction and fed directly back through the gate 60. The now deflecting down gate 60 (as shown in its solid line position in FIG. 1) deflects the document into the path 58 which feeds directly onto the platen 23. Thus, in this non-inverting path 58, the documents arrive at the platen with the same orientation as their original orientation in tray 22.

In contrast, the first inverting transport path 54 transports the documents unidirectionally and without reversal fully around the roller 40 onto the platen 26. Thus, the orientation or facing on the copy platen 23 of documents fed through the simplex path 54 is inverted from the previous orientation of those documents in the tray 22.

It may be seen that the return path of the documents to the tray 22 from the platen after they are copied is always the same here, regardless of which of the two initial paths 54 or 58 is used. This document return path has one sheet inversion, provided by feeding the documents around a second, but non-reversing, inverting roller document feeding system 42, which also returns the documents to restack on the top of the stack in tray 22.

Thus, in the total circulation path from the bottom of the tray 22 back to the top thereof, with the selection of the transport path 54 the documents are inverted twice around both rollers 40 and 42, whereas with the selection of the transport path 58 the documents are only inverted once. Therefore, it may be seen that the reversal or non-reversal of the roller 40 and the coordinate actuation or non-actuation of the selector gate 60 therewith during a document set circulation determines whether that set of documents will be recirculated with a total of one or two inversions in that circulation. (In either case, since the documents can be continuously restacked simultaneously with continuous feeding by the feeder 28, continuous multiple recirculations can be provided for precollation copying.) With two total path inversions per circulation (i.e. utilizing the path 54), there is effectively no inversion per circulation. Thus, the documents will be restacked in the tray 22 in their same original orientation, and the same sides of the documents will be exposed in the next circulation. In contrast, with only one total path inversion per circulation (using the path 58) the documents will be restacked in the tray 22 inverted from their previous orientation. Thus, the apparatus of path 58 is referred to as the "inverter" because its total circulation path effect is inversion, even though its local effect is actually non-inversion as noted above.

In the method of precollation copying of a set of plural (multipage) simplex document sheets disclosed herein, the document sheets are presented to the imaging station 23 of the copier 10 in N to 1 or conventional reverse serial page order. They are multiply recirculated between the stacked set of the document sheets and the imaging station, and copied only once on one side per circulation at the imaging station, by feeding the document sheets seriatim from the bottom of the stack to one side of said imaging station and then returning the document sheets from the opposite side of said imaging station to the top of said same stack, in a recirculatory loop path, in said multiple circulations. The set of simplex document sheets are stacked in proper page order, face-up, with the first page on the bottom of the stack, in the stacking position 22 overlying the imaging station 23.

As noted, in the above-cited system disclosed in Adamak U.S. Pat. Nos. 4,116,558, Sahay 4,278,334, etc. for making duplex copies from simplex document sheets in a desired manner, in the first copying circulation and the last copying circulation of the set of document sheets only every alternate document sheet is copied at the imaging station to fill and deplete a buffer set, respectively, but in all other circulations all documents are copied, with alternate feeding from a main copy tray and the duplex copy tray. A final non-copying document circulation may be provided to recollate the document set in its tray.

In the system here, no hardware changes are required and improved efficiency but fully compatible precollation copying may be provided with this same disclosed document handler, same copier, and same imaging station and same stacking of the document sheets merely by applying a different selectable software program to the copier programmer under the special conditions and inputs described herein to provide a different process of copying or not copying selected document pages onto selected copy sheets.

The operation of inverter mechanisms utilizing a sheet reversal path can increase reliability problems, particularly if it must be frequently used for multiple recirculations of a document set or used for many of the copy sheets. The present system does not require the the use of the duplex document transport path 58 for simplex documents, nor does it require frequent use of a copy sheet inverter e.g. 116. The use of any inverting path is normally much less than the total number of copy sets made with this system. Furthermore, this system is fully compatible with duplex document recirculation without increasing the number of inverter operations for the duplex documents either.

The exemplary copier 10 processor and its controller 100 will now be described in further detail. The copier 10 conventionally includes a xerographic photoreceptor belt 12 and the xerographic stations acting thereon for respectively charging 13, exposing 14, developing 15, driving 16 and cleaning 17. The copier 10 is adapted to provide duplex or simplex precollated copy sets from either duplex or simplex original documents copied from the same RDH 20. Two separate copy sheet trays 106 and 107 are provided for feeding clean copy sheets selectably from either one. They are known as main tray 106 and auxiliary tray 107. The control of all sheet feeding is, conventionally, by the machine controller 100.

The controller 100 is preferably a known programmable microprocessor, exemplified by the art cited above, which conventionally also controls all of the other machine steps and functions described herein including the operation of the document feeder, the document and copy sheet gates, the feeder drives, etc.. As further disclosed in those references, the controller 100 also conventionally provides for storage and comparison of the counts of the copy sheets, the number of documents recirculated in a document set, the number of copy sets selected by the operator through the switches thereon, time delays, jam correction control, etc..

The copy sheets are fed from a selected one of the trays 106 or 107 to the xerographic transfer station 112 for the conventional transfer of the xerographic toner image of a document page to the first side of the clean copy sheet. The copy sheets here are then fed by a vacuum transport to a roll fuser 114 for the fusing of the toner image thereon. From the fuser, the copy sheets are fed onto a gate or fingers 118 which functions as an inverter selector. Depending on the position of the gate 118 the copy sheets will either be deflected into a sheet inverter 116 or bypass the inverter 116 and be fed directly on to a second decision gate 120. Those copy sheets which bypass the inverter 116 (path I') turn a 90° corner in the sheet path before reaching the gate 120, which inverts the copy sheets into a face-up orientation, so that the image side which has just been transferred and fused is face-up at this point. If the inverter path 116 is selected the opposite is true (the last printed face is face-down at this point).

The second decision gate 120 then either deflects the sheets directly into an output tray 122 or deflects the sheets into a transport path which carries them on without further inversion to a third decision gate 124. This third gate 124 either passes the sheets directly on without inversion into the output path 128 of the copier, or deflects the sheets into a duplex inverting roller transport 126. The inverting transport 126 inverts and then stacks copy sheets to be duplexed in a duplex tray 108 when the gate 124 so directs.

The duplex tray 108 provides intermediate or buffer storage for those copy sheets which have been printed on one side and on which it is desired to subsequently print an image on the opposite side thereof, i.e. the sheets being duplexed. Due to the sheet inverting by the roller 126, these buffer set copy sheets are stacked into the duplex tray 108 face-down. They are stacked in this duplex tray 108 on top of one another in the order in which they were copied.

For the completion of duplex copying, the previously simplexed copy sheets in the tray 108 are fed seriatim by its bottom feeder 109 from the duplex tray back to the transfer station 112 for the imaging of their second or opposite side page image, through basically the same copy sheet path (paper path) as is provided for the clean (blank) sheets from the trays 106 or 107. It may be seen that this copy sheet feed path here between the duplex tray 108 feeder 109 and the transfer station 112 has an inherent inversion which inverts the copy sheets once. However, due to the inverting roller 126 having previously stacked these buffer sheets printed face-down in the tray 108, they are presented to the photoreceptor 12 at the transfer station 112 in the proper orientation, i.e. with their blank or opposite sides facing the photoreceptor 12 to receive the second side image. This is referred to as the "second pass" for the buffer set being duplexed. The now duplexed copy sheets are then fed out through the same output path through the fuser 114 past the inverter 116 to be stacked in tray 122 or fed out past the gate 124 into the output path 128.

The output path 128 transport finished copy sheets (simplex of duplex) either to another output tray as shown in FIG. 2 or, preferably, to a finishing station where the completed precollated copy sets may be separated and finished by on-line stapling, stitching, glueing, binding, and/or off-set stacking (shown in FIG. 2).

If alternative non-precollated output is provided, as by using the RDH 20 in a semi-automatic stream feeding mode utilizing only platen transport 30, or alternative manual document placement, then the output path 128 may connect to a sorter. The sorter can have an inherent sheet path inversion if alternative 1 to N order document placement is used.

It is desirable to minimize the operation of the copy sheet output inverter 116, in order to simplify and shorten the paper path and increase its reliability. Its use also depends on the inherent inversions provided within the paper path of the copier. The exemplary conventional inverter 116 here operates by the gate 118 deflecting a copy sheet face-down into the first or lower nip of the illustrated three roll inverter, which drives the sheet into the inverter chute. The copy sheet's movement is then reversed within the inverter chute by known or suitable sheet reversing means, e.g., further rollers, or resilient rebound members, and the copy sheet is then reversed and driven out of the inverter 116 through the second or upper nip of the same three roll inverter directly toward the gate 120. The convex shape of the inverter chute acting on the beam strength of the sheet causes the sheet trail edge to flip up toward this second nip. The copy sheet output from the inverter 116 to the gate 120 here is thereby last-printed-face-down. Note that the inverter 116 here is positioned at a corner of an otherwise inherent 90° paper path inversion as described above. However, any other suitable sheet inverter may be utilized, and may be provided at different positions in the copy sheet output path. Examples of similar or substitutable sheet invertes are disclosed in U.S. Pat. Nos. 2,901,246; 3,337,213; 3,416,791; 3,523,687; 3,856,295; and 4,044,285.

By way of further background, as to the difficulties in copy sheet output orientation and order for precollation, for which the inverter 116 may be utilized, there are several known problems and solutions in maintaining the proper collation of the copy sheets in the output tray or finisher, particularly with reproducing machines which must do both simplexing and duplexing, as discussed in the cited U.S. Pat. No. 4,278,344 and elsewhere. FIG. 2 illustrates proper collated output copy sheet stacking, i.e. face-up for N–1 page order copying. Collated duplex copying output presents particular output collation difficulties and requirements, depending on which side is printed last, etc.. As noted above, a lower and odd, document page number must be on one side of a duplex copy sheet and the next higher, and even, document page number must be on the opposite side of that copy sheet; so that in each set of copies the outputted duplex copies as picked up by the operation are in the proper page order $\frac{1}{2}$; $\frac{3}{4}$; 5/6; etc., even though copied in the reverse page order. Providing properly collated output without normally using an inverter is made more difficult for duplex copies by the fact that the total overall copy sheet path for the copies being duplexed is typically different, i.e., contains more inversions, than the overall copy path for copy sheets which are only being simplexed, since it is necessary to turn the duplex copy sheets over to present their opposite sides for their second copying pass. In the particular duplex sheet path herein each sheet to be duplexed is inverted once at the duplex tray input 126, a second time in the return path to the transfer station 112, and a third time in the path from the transfer station 112 to the output 128, to exit last-printed-face-up. Thus, if the second sides printed are the odd sides, a N to 1 output may be stacked with these last-printed odd sides facing up as in FIG. 2 without using inverter 116. It is desirable to have commonality, i.e., to utilize the same sheet feeding path to the maximum extent possible for both duplex and simplex copies, and to thus normally avoid using a selectable output inverter for either.

In the N to 1 simplex/duplex document copying sequence shown in FIG. 2, the next higher and even numbered pages are properly printed on the second side of the duplex copy sheets in their second pass through the transfer station 112 here. That is, page 2 is printed on the opposite side of page 1. With N to 1 copying and an "odd" page buffer set, the last-printed page in each set is always two printed on the back of the page one sheet and this last duplex copy sheet is exited with page two down.

The inverter 116 path is illustrated in FIG. 2 as an alternative in dashed lines. However, as otherwise discussed herein, it is normally bypassed (path Γ) here by gate 118. This same path Γ in FIG. 2, normally avoiding the inverter 116, is also used for simplex copies, which is an important advantage.

By way of further background, there is an additional problem in the situation where there is an odd rather than even number of simplex document pages to be copied onto a duplex copy set. With an odd number of document pages the Nth or first-copied page of the set of duplex copies made therefrom in N to 1 order is really a simplex copy. That is, the bottom copy sheet in each copy set will have an image on only one side (of the odd Nth page) and a blank back side. It is undesirable to run this Nth page only copy sheet through the transfer station a second time for the pseudo printing of a blank image on the back side thereof simply to obtain an additional inversion of that sheet to maintain output collation, since this wastes processing time and also can cause undesirable background contamination of the blank side of this sheet. This can be avoided by printing the Nth page on a clean sheet from tray 106 or 107 and directly outputting the Nth duplexed copy sheet immediately after its fist side is printed rather than feeding it from or into the duplex tray 108. This normally results in this particular copy sheet having a different number of inversions, as discussed, but this particular sheet can then be inverted by the inverter 116, if needed.

However, to treat an odd Nth duplex copy page differently in this manner, or to know whether the first duplex buffer set in tray 108 comprises odd or even pages (essential to maintaining output collation) it must be known in advance whether there are an odd or even number of simplex documents. If the documents were being copied in forward serial order, i.e. 1 to N, this would not be a problem. The Nth copy sheet page will only need to be fed and copied after the last (Nth) document in the set has been counted, and the bail switch 26 actuated, which determines whether or not N is an odd number.

However, as here, when the simplex documents are copied in reverse serial order (N to 1) the first document fed is page N and the first (Nth) duplex copy sheet will be the one requiring special duplex processing, i.e., having a blank back side when N is odd. Since this Nth copy sheet is fed first it is not known whether the Nth document page is odd or even until after the documents have all been counted in the first document set circulation, which reduces the efficiency of the system.

Pre-printed, e.g. letterhead, copy sheets present a special problem. They cannot have a first even page printed on the front (pre-printed) side. That is, page 1 must be on the letterhead side and properly oriented with the pre-printing orientation. This is an additional complication for duplex copies. For said simplex/duplex copying, by loading letterhead or other special paper face-up in the trays 106 and 107 and copying odd page documents on the first pass, the odd pages will be properly printed on the front or letterhead sides of the letterhead copy sheets here, since the copy paper path here contains one inversion between trays 106 and 107 and the transfer station 112. Then on the next circulation these duplex copy sheets will have even pages properly printed on their back sides.

However, for edge oriented pre-punched binder holes and certain other special papers even the above may not provide proper (common) sheet orientation of an odd Nth page duplex copy sheet. There can be additionally provided a "special paper" or the like operator button 200 on the copier console for the controller 100. The controller can then be programmed to detect the coincidence of signals from (1) this "special paper" button being pressed and (2) "simplex documents" and (3) "duplex" buttons also having been pressed. Upon detection of all of these conditions the controller 100 can direct special processing.

A duplex/duplex copying system, compatible with the simplex/duplex system disclosed herein, can provide as disclosed in the above-cited U.S. Pat. No. 4,278,344. Briefly, the duplex documents may also be loaded face-up and copied in N to 1 order. The duplexing system disclosed therein is to copy only one side of each duplex document sheet in each circulation, storing the buffer set copies thereof in the duplex tray 108, then inverting the duplex document sheets during a circulation, and copying all of the opposite sides of all the document sheets onto the opposite sides of the buffer set copy sheets fed back from the duplex tray 108. The controller 100 is instructed by its software to provide this copying sequence in response to the "duplex document" switch on its console or in the RDH unit having been actuated by the operator. Since duplex/simplex copying is not provided here, this same duplex document switch can also automatically select the duplex copy mode.

Thus, this simplex/duplex system here is fully compatible with the special duplex/duplex system disclosed in the above-cited U.S. Pat. No. 4,278,344 to R. B. Sahay, in which the inverter (40, 60) path 58 is only utilized intermittently between successions of plural copying circulations of the duplex documents, i.e. in which plural buffer sets are placed in the duplex tray 108 and the document inverter operation path 58 is utilized only during single document circulations at the beginning or end of a succession of circulations, after the document set has been circulated by a number of times (not exceeding the sheet capacity of the tray 108) thereby significantly reducing the number of circulations requiring the operation of the document inverter, except for very large document sets. Thus, for an example of a four-sheet and 7-page duplex document set, and a 100 sheet capacity duplex tray 108, the 4 duplex documents could be circulated 25 times through path 54 at the beginning of copying to form 25 four-sheet buffer sets in the tray 108. These four copy sheets would respectively bear pages 7, 5, 3, 1. Then on the 26th document circulation the duplex document set would be circulated once through the path 58. Then the document set would be circulated again through the path 54 for the next 24 circulations. In circulations 26 through 50 here, the pages 6, 4, 2, blank would be printed in that order 25 times on the back of the buffer set sheets fed from the duplex tray 108 until all 25 duplex copy sets have been printed and exited. Then this sequence would repeat until the requested number of copies were completed. (Assuming that more than 25 copy sets had been requested by the operator through the appropriate switch selection in the controller 100).

TABLE I

A TWO ORIGINAL DOCUMENT SET AND SIMPLEX/DUPLEX COPYING

| Number of Sets Made | Pitch/Cycle | 1 2 3 4 5 6 7 8 9 0 1 2 3 4 5 6 7 8 9 0 1 2 3 4 5 6 7 8 9 0 1 2 3 |
|---|---|---|
| ONE | Doc. on Platen | 2 1 2 1 * * * * * * * * * * 2 1 |
| | Paper Feed | * * * m * * * * * * * * * * d * |
| | Flash | * * * X * * * * * * * * * * X * |
| TWO | Doc. on Platen | 2 1 2 1 1 * * * * * * * * * 2 2 1 |
| | Paper Feed | * * * mm * * * * * * * * * d d * |

TABLE I-continued

A TWO ORIGINAL DOCUMENT SET AND SIMPLEX/DUPLEX COPYING

| Number of Sets Made | Pitch/Cycle | 1 2 3 4 5 6 7 8 9 0 1 2 3 4 5 6 7 8 9 0 1 2 3 4 5 6 7 8 9 0 1 2 3 |
|---|---|---|
| | Flash | * * * XX* * * * * * * * XX* |
| THREE | Doc. on Platen | 2 1 2 1 1 1 * * * * * * * 2 2 2 1 |
| | Paper Feed | * * * mmm* * * * * * * d d d * |
| | Flash | * * * XXX* * * * * * * XXX* |
| FOUR | Doc. on Platen | 2 1 2 1 1 1 1 * * * * * * 2 2 2 2 1 |
| | Paper Feed | * * * mmmm* * * * * * d d d d * |
| | Flash | * * * XXXX* * * * * * XXXX* |
| FOURTEEN* | Doc. on Platen | 2 1 2 1 1 1 1 1 1 1 1 1 1 1 1 1 * 2 2 2 2 2 2 2 2 2 2 2 2 2 2 1 |
| | Paper Feed | * * * mmmmmmmmmmmmmm* d d d d d d d d d d d d d d * |
| | Flash | * * * XXXXXXXXXXXXXX* XXXXXXXXXXXXXX* |
| | Buffer Set | built depleted |
| | Doc. Circ. | / 1 / 2 / 3 / |

*repeated if number of sets requested exceeds 14

TABLE II

A THREE ORIGINAL DOCUMENT SET AND SIMPLEX/DUPLEX COPYING

| Number of Sets Made | Pitch/Cycle | 1 2 3 4 5 6 7 8 9 0 1 2 3 4 5 6 7 8 9 0 1 2 3 4 5 6 7 8 9 0 1 2 |
|---|---|---|
| ONE | Doc. on Platen | 3 2 1 3 2 1 * * * * * * * * 3 2 1 |
| | Paper Feed | * * * * * m* * * * * * * * md * |
| | Paper Feed | * * * * * X* * * * * * * * XX* |
| TWO | Doc. on Platen | 3 2 1 3 2 1 1 * * * * * * * 3 2 1 3 2 1 |
| | Paper Feed | * * * * * mm* * * * * * * md * md * |
| | Flash | * * * * * XX* * * * * * * XX*XX* |
| THREE | Doc. on Platen | 3 2 1 3 2 1 1 1 * * * * * * 3 2 1 3 2 1 3 2 1 |
| | Paper Feed | * * * * * mmm* * * * * * md * md * md * |
| | Flash | * * * * * XXX* * * * * * XX* XX* XX* |
| FOUR | Doc. on Platen | 3 2 1 3 2 1 1 1 1 * * * * * 3 2 1 3 2 1 3 2 1 3 2 1 |
| | Paper Feed | * * * * * mmmm* * * * * md * md * md * md * |
| | Flash | * * * * * XXXX* * * * * XX* XX* XX* XX* |

The above pattern holds for up to four sets. For five or six sets (or more) the pattern is shown below. The number of initial copies of page 1 is held at four (i.e., four buffer sets).

| | | |
|---|---|---|
| FIVE | Doc. on Platen | 3 2 1 3 2 1 1 1 1 * * * * * 3 2 1 3 2 1 3 2 1 3 2 1 3 2 1 |
| | Paper Feed | * * * * * mmmm* * * * * md mmd * md * md * md * |
| | Flash | * * * * * XXXX* * * * * XXXXX* XX* XX* XX* |
| SIX | Doc. on Platen | 3 2 1 3 2 1 1 1 1 * * * * * 3 2 1 3 2 1 3 2 1 3 2 1 3 2 1 3 2 1 |
| | Paper Feed | * * * * * mmmm* * * * * md mmd mmd * md * md * md * |
| | Flash | * * * * * XXXX* * * * * XXXXXXXX* XX* XX* XX* |
| | Buffer Set | built 3 build/ deplete cycles depleted |
| | Doc. Circ. | / 1 / 2 / 3 / 4 / 5 / 6 / 7 / 8 / |

TABLE III

A FOUR ORIGINAL DOCUMENT SET AND SIMPLEX/DUPLEX COPYING

| Number of Sets Made | Pitch/Cycle | 1 2 3 4 5 6 7 8 9 0 1 2 3 4 5 6 7 8 9 0 1 2 3 4 5 6 7 8 9 0 1 2 3 4 5 6 7 |
|---|---|---|
| ONE | Doc. on Platen | 4 3 2 1 4 3 2 1 * * * * * * * 4 3 2 1 |
| | Paper Feed | * * * * * m* m* * * * * * * d * d * |
| | Flash | * * * * * X* X* * * * * * * X* X* |
| TWO | Doc. on Platen | 4 3 2 1 4 3 2 1 4 3 2 1 * * * 4 3 2 1 * * 4 3 2 1 |
| | Paper Feed | * * * * * m* m* m* m* * * d * d * * * d * d * |
| | Flash | * * * * * X* X* X* X* * * X* X* * * X* X* |
| FOUR | Doc. on Platen | 4 3 2 1 4 3 2 1 4 3 2 1 * * * 4 3 2 1 * * 4 3 2 1 * * 4 3 2 1 * * 4 3 2 1 |
| | Paper Feed | * * * * * m* m* m* m* * * md md * * md md * * d * d * * * d * d * |
| | Flash | * * * * * X* X* X* X* * * XXXX* * XXXX* * X* X* * * X* X* |
| | Buffer Set | 1st bld. 2nd bld. 2 build/ depletes dep. dep. |
| | Doc. Circ. | / 1 / 2 / 3 / 4 / 5 / 6 / 7 |

TABLE IV

A FIVE ORIGINAL DOCUMENT SET AND SIMPLEX/DUPLEX COPYING

| Number of Sets Made | Pitch/Cycle | 1 2 3 4 5 6 7 8 9 0 1 2 3 4 5 6 7 8 9 0 1 2 3 4 5 6 7 8 9 0 1 2 3 4 5 6 7 8 9 0 |
|---|---|---|
| ONE | Doc. on Platen | 5 4 3 2 1 5 4 3 2 1 * * * * * * 5 4 3 2 1 |

TABLE IV-continued

A FIVE ORIGINAL DOCUMENT SET AND SIMPLEX/DUPLEX COPYING

| Number of Sets Made | Pitch/Cycle | 1 2 3 4 5 6 7 8 9 0 1 2 3 4 5 6 7 8 9 0 1 2 3 4 5 6 7 8 9 0 1 2 3 4 5 6 7 8 9 0 |
|---|---|---|
| | Paper Feed | * * * * * * * m* m* * * * * * md * d * |
| | Flash | * * * * * * * X* X* * * * * * XX* X* |
| TWO | Doc. on Platen | 5 4 3 2 1 5 4 3 2 1 5 4 3 2 1 * 5 4 3 2 1 * 5 4 3 2 1 |
| | Paper Feed | * * * * * * * m* m* * m* m* md * d * * md * d * |
| | Flash | * * * * * * * X* X* * X* X* XX* X* * XX* X* |
| FOUR | Doc. on Platen | 5 4 3 2 1 5 4 3 2 1 5 4 3 2 1 * * 5 4 3 2 1 * 5 4 3 2 1 * 5 4 3 2 1 * 5 4 3 2 1 |
| | Paper Feed | * * * * * * * m* m* * m* m* * md md m* md md m* md * d * * md * d * |
| | Flash | * * * * * * * X* X* * X* X* * XXXXX* XXXXX* XX* X* * XX* X* |
| | Buffer Set | 1st bld. / 2nd bld. / build/ deplete / deplete buffer |
| | Doc. Circ. | / 1 / 2 / 3 / 4 / 5 / 6 / 7 / |

TABLE V

A SIX ORIGINAL DOCUMENT SET AND SIMPLEX/DUPLEX COPYING

| Number of Sets Made | Pitch/Cycle | 1 2 3 4 5 6 7 8 9 0 1 2 3 4 5 6 7 8 9 0 1 2 3 4 5 6 7 8 9 0 1 2 3 4 5 6 |
|---|---|---|
| ONE | Doc. on Platen | 6 5 4 3 2 1 6 5 4 3 2 1 * * * * * 6 5 4 3 2 1 |
| | Paper Feed | * * * * * * * m* m* m* * * * * d * d * d * |
| | Flash | * * * * * * * X* X* X* * * * * X* X* X* |
| TWO | Doc. on Platen | 6 5 4 3 2 1 6 5 4 3 2 1 6 5 4 3 2 1 6 5 4 3 2 1 6 5 4 3 2 1 |
| | Paper Feed | * * * * * * * m* m* m* m* m* md * d * d * d * d * d * |
| | Flash | * * * * * * * X* X* X* X* X* XX* X* X* X* X* X* X* |
| THREE | Doc. on Platen | 6 5 4 3 2 1 6 5 4 3 2 1 6 5 4 3 2 1 6 5 4 3 2 1 6 5 4 3 2 1 6 5 4 3 2 1 |
| | Paper Feed | * * * * * * * m* m* m* m* m* md md md md * d * d * d * d * d * |
| | Flash | * * * * * * * X* X* X* X* X* XXXXXXXX* X* X* X* X* X* X* |
| | Buffer Set | 1st bld. / 2nd bld. / build/ dep. / 1st dep. / 2nd dep. |
| | Doc. Circ. | / 1st / 2nd / 3rd / 4th / 5th / 6th / |

Referring now to the special copying sequences for small document sets shown in the enclosed Tables I–V, they provide higher efficiency with reduced document circulations and/or reduced total copying time compared to the above-described normal simplex/duplex precollation copying method. First the special case in Table I of precollation simplex/duplex copying of a simplex document set of only two sheets (two pages) will be discussed, then the 3-page document set situation is shown in Table II, etc.. There is disclosed in each Table a unique document copying sequence or mode of operation for improved efficiency in that special case, with reduced skipped pitches or cycles. Note that there are actually five individual tables forming Table I, showing the respective document and copy sequencing for runs of "One", "Two", "Three", "Four", and "Fourteen" requested copy sets. The other tables are similarly organized.

In all of the Tables I-V the horizontal lines labeled "Doc. on Platen" indicate which of the document pages is on the platen at that point in time (e.g. 1 or 2 in Table I). In the "Paper Feed" lines the symbol "m" designates a clean copy sheet fed from either the main or auxiliary sheet feeder (trays 106 or 107), while "d" designates a buffer set copy sheet fed from the duplex feeder (tray 108). In the "Flash" lines the "X" indicates a flash exposure in that pitch (vertical column) of the document page shown vertically thereabove in the "Doc. on Platen" line onto the copy sheet shown thereabove in the "Paper Feed" line. In all of said 3 horizontal lines for each set number each asterisk designates one skipped pitch or cycle there, i.e. a time delay.

Note that the repeated "Machine Pitch/Cycle" numbers 1 through 9 and 10 (ten pitches) in the top line of each table are each a preset time period corresponding to one sheet path space or pitch and are each equated to one document cycle, i.e. one document feed or one pause in document feeding. This pitch or cycle count is repeated at each 10 pitches here merely for tabulation space convenience (to use only single digits). The number of circulations of the entire document set is the number of repetitions of all the document page numbers in the "Doc. on Platen" lines (reading across). This is also illustrated in the "Doc. Circ." line, which, however, is shown only for the highest set number shown in each table, e.g. only for the 14 page document example in Table I. Also for clarity the "Buffer Set" line is shown only for the last example in each table, to illustrate the formation and depletion of plural buffer sets of the copy for that one case.

Note that, as previously discussed, in each Table I–V this operation assumes in each case an N to 1 (reverse order) unidirectional copying system with an initial non-copying circulation of the document set in which the number of simplex documents is counted to determine the number of document pages and whether the Nth document page is even or odd. Thus for example, in Table I in all cases there is no "Paper Feed" and no "Flash" for (under) the first "Doc. on Platen" circulation "21".

In Table I the first copy is made (of page 1) only on the 4th pitch, which is at the end of the second document set circulation. Then, on the 4th up to 14th pitch, up to 14th plural identical copies are made of page 1, corresponding to the number of copy sets being made, rather than circulating the documents, contrary to conventional precollation copying, to form up to 14 plural buffer sets consisting only of page 1's. For more than 14 requested copy sets the pattern is repeated rather than increasing the size of the buffer set beyond 14 sheets.

A brief verbal description of the operations illustrated in Table I (from right to left) is as follows:

Step 1: (Pitches 1 and 2) Make a first non-copying circulation of both document sheets (pages 2 and 1) to make a set count determination that there are only two sheets in the simplex document set, and therefore that the second document sheet (page 1) is the odd page, without a paper feed or flash.

Step 2: (Pitches 3 and 4) On the second document circulation (the first copying circulation) stop the odd page (page 1) on the platen and without any further document circulation copy page 1 (flash it) by the number of times in immediate succession (up to 14) equal to the desired total number of copy sets, making these plural copies on clean sheets fed from a main tray and placed after copying in the duplex tray (i.e. one copy of page 1 for 1 set, two copies of page 1 for two sets, etc, up to 14 copies of page 1 for 14 sets). (Note that this is not normal precollation copying, which would be to circulate the documents and only make one page 1 copy in each circulation.)

Step 3: Then feed the next (other) document (page 2) to the platen, and after an appropriate variable pause (in pitches) (to allow the first buffer copy cycled through the proper path to reach its proper position for duplexing) copy this document page 2 in direct immediate succession without circulation the same number of times as in step 3 onto the other sides of the buffer copy sheets fed from the duplex tray (only). The length of this document recirculation and copying pause is a function of the length of the paper path of the particular copier processor from transfer station 112 to buffer tray 108 and the number of buffer sheets being made. For 14 or more sets there need only be a single (as shown) or no pitch pause i.e. up to 100% efficiency. Further, there are (desirably) only 3 document circulations in all cases for up to 14 copy sets.

Step 4: (Occasional) If more than 14 copy sets are requested, the number of copies made in steps 3 and 4 is limited to 14 (and to not exceed the capacity of the duplex tray) and there is further document set circulation with a repetition of steps 3 and 4 to complete the desired total number of sets. That is, the sequence shown in Table I, last example, is repeated, as indicated.

Step 5: Complete the last (second) document circulation without further copying simply to return page 1 to the document input tray.

As an alternative to the system of Table I (a variation) if the controller logic system could respond in time to the end of set signal from sensor 28 one of the following more efficient alternatives may be used instead:

A. Begin making the selected plural copies of page 1 (step 2 above) at the end of the first document set circulation rather than the second document set circulation. Note that the end of set finger 26 in the document tray has already dropped to indicate the completion of document counting by switch 26 before page 1 has been ejected from the platen, since page 1 was the last document fed out from under the set counter finger.

B. Alternatively, copy page 2 first rather than page 1 in the second set circulation (i.e. reverse steps 2 and 3 above) (noting that for this 2-page original document set that the duplex set copies thereof have only a single sheet in each set, and therefore their output orientation could be either face-up or face-down). (I.e. with a single sheet output set, no output collation is required.) However, odd page first copying may be required for letterhead, edge binder hole or other output or copy sheet restraints even for single sheet two-page output sets.

Turning now to Table II, the respective higher efficiency operations are shown for runs of one, two, three, four, five and six precollated copy sets from the special case of a set of three original simplex document sheets being recirculated. This desired sequence is similar but even more complicated. For one to four copy sets the first two steps are basically the same as the above-described first two steps, i.e. holding page 1 on the platen for up to four copies in a row thereof. However there is the additional step of copying document page 3 onto a main tray sheet before page 2 is copied each time. But for four or more sets the number of copies made of page 1 in sequence in the second circulation (step 2) does not exceed four here. This has been found to provide a more efficient (less pitches required) copying sequence for this processor, but may vary somewhat for other processors, e.g. may be 3 copies of page 1 (or 2) for a different processor. After the second document circulation the documents are recirculated and all copied only once per circulation for normal intermediate build/deplete cycles of the buffer set. Then on the final copying circulations the processor skips copying of page 1 for the number of copies previously made thereof on the first copying circulation to deplete the plural buffer sets (which, as in Table I, consists only of plural identical copies of page 1).

The example shown schematically in FIG. 2 of the drawing is for said three-page original document set system of Table II. The FIG. 2 example shows three completed copy sets in the output tray at the right-hand side of FIG. 2 and a full buffer tray 108 set of four sheets, i.e. a running situation in which the operator has requested four or more copy sets and only three have been completed at the point in time illustrated. At the end of the last requested copy set the duplex tray 108 would be empty, having been depleted as shown in Table II.

Table III illustrates the algorithm for a four-document sheet simplex document set. Examples in Table III are provided for one, two and four copy set runs of the four document sheets. For only the four set example, additional lines are shown for the document set circulations and buffer sets. In this special case of 4 documents the most efficient buffer comprises 2 buffer sets (each here containing copies of pages 1 and 3). That is, the complete (full) buffer set in the duplex tray is a stack of 4 sheets copied on their downward facing sides with pages 3, 1; 3, 1. These two buffers sets are initially formed on the second and third document set circulations, and depleted out on the last and next to last document circulations. Note that there are no plural consecutive copies of any document page, and that the individual buffer sheets are not identical or interchangeable, but the two complete buffer sets are.

Tables IV and V are respectively for the cases of five-document and six-document sets. They are processed similarly to the four-document set of Table III. However, the Table IV case with five documents has an odd Nth page requiring special processing as in Table II.

Referring to Tables II and IV, it is important to note, as described previously, that in an N to 1 order copying system where odd pages are buffered, as in all cases here, that for all of the odd numbered document sets (regardless of size) that the last page of the copy set (e.g. page 3 in Table II or page 5 in Table IV) is copied first, but preferably not buffered, i.e. the Nth odd page is copied first an onto a clean sheet fed directly from the main or auxiliary copy tray and fed directly to the output. Therefore in Table II the buffer set consists only of copies of page 1 (not 3). Likewise in Table IV the buffer set duplex tray 108 contains only copies of pages 3 and 1 (not 5). However, it should be noted that in another (alternative) system that the even pages may be buffered rather than the odd pages.

In Table II, all the buffer pages are identical copies of only page 1 in this special (3 page original) case, the same as in the 2 original case of Table I. Thus it has been discovered that for the special case of only 2 or 3 originals plural buffer pages may be accumulated and their copying order and feeding out order is not critical i.e. is immaterial which of the identical page 1 bearing copy sheets fed into the duplex tray 108 is fed out with this system. That is, the order of sheets in the buffer need not be maintained. This feature is advantageously utilized here by switching to a special copying mode of operation maximizing productivity for two or three-page original sets. In this special higher productivity mode of Tables I and II, rather than copy each document page only once per circulation, as conventionally considered necessary for precollation copying (to provide collated output sets), the first page, which is the first page, which is the second and last fed document sheet, is copied a plural number of times in succession, dependent on the number of copy sets being made in the first copying circulation (i.e. the first document circulation after the initial non-copying counting circulation) to make up a plural sheet buffer of an equal number of said page 1 copies. Then on the last copying circulation for the last copy set this plural sheet buffer is depleted (emptied out) by plurally copying the other sides thereof (with equal plural copies of page 2).

As noted, for the two-original set of Table I this above-described special system is utilized for up to 14 consecutive copies to form a 14 sheet buffer set, then repeated. However that break point number is a function of the paper path lengths and the duplex tray capacity of the particular processor example, and will vary. In this processor example there are slightly more than 9 pitches of paper path length to the duplex tray in copying the first sides. Thus there are 9 asterisks (a 9 pitch pause) in the "ONE" set example of Table I between the second and third circulations. For a shorter paper path the maximum efficiency system (elimination of any skipped pitches) may be reached with less plural copies (a smaller buffer set). For job recovery, a smaller buffer set is desirable, since there are less sheets to throw away and/or recycle in the event of a jam.

Likewise in Table II, the maximum number of plural copies of page 1 placed in the buffer tray in the second (first copying) document circulation (pitches 6 through 9) is four ("1111") for this processor example. However, this could be 3 or even 2 for a shorter paper path.

All the disclosed algorithms are designed to maximize efficiency by keeping the paper path full most of the time and eliminating dead pitches (document copying pauses) as much as possible. However, for the Table III–V special cases, the system builds two plural sheet buffer sets when the number of originals is determined to be 4, 5 or 6. When the number of originals counted in the document set is greater than 9 it changes its mode to the conventional single buffer set algorithm. In contrast, in the special cases where the document set is determined to consist of only two or three sheets the plural buffer sets (normally more than two and up to 14, or 4, respectively) are made while stopping the document circulations to make buffer sets which are plural identical copies of only one document, and to reduce document circulations, especially for only two documents. In all cases other than two documents once the buffer sets are initially built they are simultaneously rebuilt and depleted during intermediate circulations until the last copy set, when the buffer sets are all fully depleted, as previously described. In all cases the subsequent buffer set(s) are made during the time while the first buffer set is in the duplex paper path loop completing its travel, thereby improving efficiency by reducing copying delays.

It will be noted in the Table III–V systems, having two buffer sets, that there will be one less intermediate (build and deplete) document recirculation than normal which would appear to reduce efficiency per se. (I.e. there are 4 cycles of only alternate document copying rather than the usual 2.) However overall efficiency is higher. In, for example, Table III, with two requested copy sets there are two buffer sets of odd pages only (3, 1; 3, 1) formed and stored during the second and third document set circulations and then depleted during the 4th and 5th circulations, (by copying only even page documents) to form the two precollated 4-page and two-copy-sheet duplex output copy sets $\frac{1}{2}$, $\frac{3}{4}$; $\frac{1}{2}$, $\frac{3}{4}$. There are no intermediate copying recirculations here until there are three or more requested copy sets. In the four set example of Table III the 4th and 5th circulations are providing two intermediate (build/deplete buffer) copying circulations.

The disclosed copier and document handler unit can automatically handle a wide latitude of original document sets with a minimum of operator interaction. In a typical job, the operator need only drop the set of documents to be copied into the open loading tray 22 on top of the RDH 20, program the desired number of copies to be made in the controller 100 switches, indicate if duplex documents rather than simplex have been loaded (by pressing a button connected to the controller 100), and then initiating the copying run sequence by pressing the conventional "start print" button on the controller. There may, of course, be some adjustment of side and rear guides in the tray 22 for different sizes of documents. Except for jam clearance, there would normally be no other interaction required with the copier or document handler to provide precollated output sets.

While the N to 1 simplex document duplex copy precollation copying system embodiment disclosed herein is preferred, it will be appreciated that this embodiment is but one example, and various alternatives, modifications, variations or improvements thereon may be made by those skilled in the art from this teaching which are intended to be encompassed by the following claims:

What is claimed is:

1. In a method or recirculatively precollatively copying a set of plural simplex original documents onto both sides of copy sheets to produce a desired plural number precollated duplex copy sheet sets, by normally copying the documents only once in each copying circulation of the document set, and by forming a buffer set of copies of alternate document pages being duplexed which buffer set copies are printed on only one side, and temporarily stored in a duplex store and by copying alternate documents onto the opposite sides of the buffer set copies in proper sequence to form collated duplex copy sets, and wherein said documents are all copied unidirectionally in reverse (N to 1) page order, the improvement comprising:

counting the number of documents in the document set and determining that said number of documents is more than three but less than approximately ten, in response to said determination, automatically switching the mode of copying said document sheets to a higher productivity small document set mode comprising the steps of initially building two complete and identical said buffer sets of alternate page documents on two initial copying circulations of said document set and placing both said identical buffer sets in the same duplex store and then skipping the copying of said alternate document pages in said two buffer sets in the final two copying circulations of said document set to deplete said two buffer sets.

2. The method of claim 1 wherein if the number of copy sets made is greater than two, all of the documents are copied in all intermediate document copying circulations (other than said first two and said last two copying circulations) to maintain said two buffer sets during said intermediate circulations by simultaneously rebuilding and depleting the two buffer sets.

* * * * *